US008955488B2

(12) United States Patent
Nödl

(10) Patent No.: US 8,955,488 B2
(45) Date of Patent: Feb. 17, 2015

(54) PISTON FOR USE IN INTERNAL COMBUSTION ENGINES

(75) Inventor: Martin Nödl, Nürnberg (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 13/979,692

(22) PCT Filed: Jan. 11, 2012

(86) PCT No.: PCT/EP2012/050347

§ 371 (c)(1),
(2), (4) Date: Sep. 3, 2013

(87) PCT Pub. No.: WO2012/095445

PCT Pub. Date: Jul. 19, 2012

(65) Prior Publication Data

US 2013/0333657 A1 Dec. 19, 2013

(30) Foreign Application Priority Data

Jan. 13, 2011 (DE) ..... 10 2011 002 653

(51) Int. Cl.
*F02F 3/00* (2006.01)
*F02F 3/02* (2006.01)

(52) U.S. Cl.
CPC .. *F02F 3/00* (2013.01); *F02F 3/022* (2013.01)
USPC ..... 123/193.6

(58) Field of Classification Search
USPC ..... 123/193.4, 193.6; 92/208, 209, 214
See application file for complete search history.

(56) References Cited

U.S. PATENT DOCUMENTS

| | | | | |
|---|---|---|---|---|
| 1,763,523 | A | 6/1930 | Jardine | |
| 3,319,535 | A * | 5/1967 | Holcombe | 92/208 |
| 3,452,649 | A * | 7/1969 | Cornet | 92/232 |
| 4,831,919 | A | 5/1989 | Bruni | |
| 4,856,417 | A * | 8/1989 | Ishikawa | 92/233 |
| 5,058,489 | A * | 10/1991 | Iwaya | 92/233 |
| 5,076,225 | A * | 12/1991 | Tokoro et al. | 123/193.1 |
| 5,299,490 | A * | 4/1994 | Harrer et al. | 92/208 |
| 2,513,814 | A | 9/1995 | Moore | |
| 5,448,942 | A | 9/1995 | Arai | |
| 6,073,602 | A | 6/2000 | Muta | |

(Continued)

FOREIGN PATENT DOCUMENTS

| | | | |
|---|---|---|---|
| DE | 3936961 | A1 | 5/1991 |
| DE | 4109968 | | 11/2001 |
| DE | 102008002536 | A1 | 1/2010 |
| DE | 102009032379 | A1 | 2/2010 |

(Continued)

*Primary Examiner* — Hung Q Nguyen
(74) *Attorney, Agent, or Firm* — Robert L. Stearns; Dickinson Wright, PLLC

(57) ABSTRACT

Piston for use in internal combustion engines, having a piston skirt composed of skirt walls and box walls, said walls enclosing a recess wherein the at least one skirt wall is provided for use on the pressure side of the piston in the installed state. Said piston is in particular characterized in that, in at least one partial region of at least one skirt wall provided for use on the pressure side of the piston, the recess is in substantially the shape of a parabola, a section of an ellipse or a catenoid, wherein said parabola, said section of an ellipse or said catenoid lies in a plane substantially parallel to the piston crown.

13 Claims, 1 Drawing Sheet

(56) References Cited

U.S. PATENT DOCUMENTS

| | | | | |
|---|---|---|---|---|
| 6,240,828 | B1 | 6/2001 | Fujimoto | |
| 6,862,977 | B2 * | 3/2005 | Glinsner et al. | 92/209 |
| 7,895,937 | B2 * | 3/2011 | Frank et al. | 92/237 |
| 2011/0168124 | A1 | 7/2011 | Nodl | |
| 2011/0174153 | A1 | 7/2011 | Hettich et al. | |

FOREIGN PATENT DOCUMENTS

| | | | |
|---|---|---|---|
| EP | 0430362 | A1 | 6/1991 |
| EP | 913566 | A2 | 5/1999 |
| EP | 0913566 | A2 | 5/1999 |
| GB | 2166217 | A | 4/1986 |
| JP | 2003083159 | A | 3/2003 |

* cited by examiner

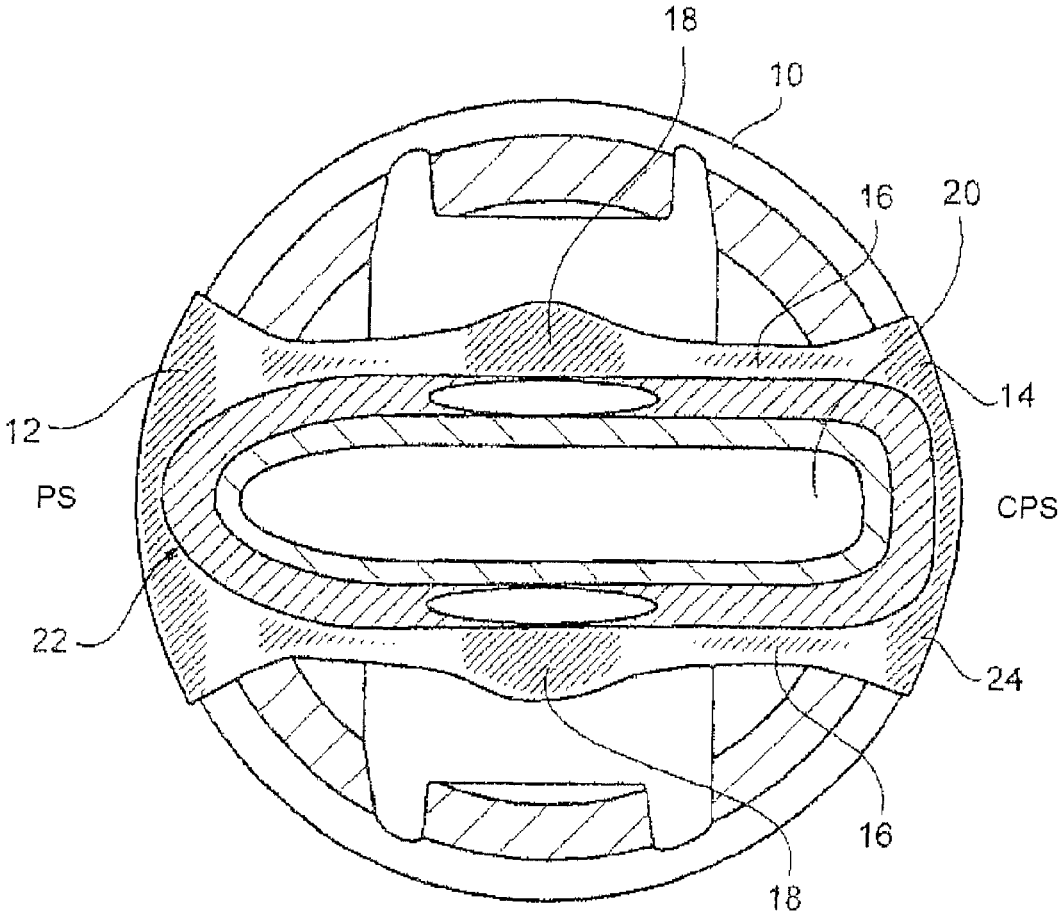
18
10
16
20
12
14
PS
CPS
22
24
16
18

PISTON FOR USE IN INTERNAL COMBUSTION ENGINES

BACKGROUND OF THE INVENTION

1. Technical Field

The invention relates to a piston for an internal combustion engine.

2. Related Art

In internal combustion engines a fuel-air mixture is periodically ignited and burned at the end of a compression stroke and at the beginning of an expansion stroke. In reciprocating piston engines, this happens in a combustion chamber which is delimited from a crankcase by a piston which moves up and down in a cylinder. The piston is connected to a crank shaft via a connecting rod. A piston pin serves in turn to connect the piston to the connecting rod, the piston pin being accommodated in a pin boss formed in the piston.

In recent years there has been a growing trend with engines towards direct fuel injection in conjunction with turbocharging. This development entails new challenges for the development of pistons, in particular in view of the steadily increasing ignition pressures together with the ever later center of gravity position of the combustion, which manifest as high lateral loads for the piston skirt. Owing to the increased loads, conventional piston concepts are increasingly unsuitable for fulfilling the requirements, particularly in view of the required durability.

In order to cope with the increased loads, DE 10 2009 032 379 A1 discloses a piston having pressure-side box walls which run in a straight line and at an inclination such that the distance of the box walls in the region of the pin boss is greater than in the region of the pressure-side skirt wall, This is supposed to improve the skirt/box wall connection.

EP 0 913 566 A2 describes a cooled piston for internal combustion engines, in which a cooling duct is formed inside the piston, which is characterized by an entry point that lies outside of the piston skirt. Improved cooling is achieved in this way.

DE 10 2008 002 536 A1 describes a piston characterized on the pressure side by connecting walls that are largely straight and by curved walls on the counter pressure side. This reduces the generation of noise and contributes to greater resilience.

A piston is revealed by DE 40 19 968 C2, the so-called skirt portion of which having on the outer side an elliptical form at least in some regions.

Pistons having skirt walls and box walls have also become known under the designations "slipper piston" and "slipper skirt", which are supposed to ensure high resilience with a low weight.

With pistons subject to high loads, there is a tendency for box wall cracks to appear in the region of the connection of the box wall to the piston skirt. These cracks are caused by a bending moment which occurs during the deformation of the piston skirt under the ignition pressure and acts in the region of the intersection between the piston skirt and the box wall. Conventional methods, in particular trying a smaller or larger intersection radius between the box wall and the side wall, have not been able to solve this problem in a satisfactory manner.

SUMMARY OF THE INVENTION

A piston is provided with reduced formation of box wall cracks in the region of the connection of the piston skirt to the box wall.

According thereto, a piston is provided for use in internal combustion engines, the piston having a piston skirt encompassing skirt walls and box walls, the skirt walls and box walls delimiting a recess, with at least one skirt wall being provided for use on the pressure side of the piston in the installed state In a region of this skirt wall the recess is delimited substantially in the form of a parabola, a section of an ellipse or a catenoid, this parabola, this section of an ellipse or this catenoid lying in a plane that is substantially parallel to the piston crown. In other words, the described form of the recess applies in at least one section where a section plane is perpendicular to the piston axis.

Particularly the form of the catenoid, i.e. the form which assumes a freely hanging chain or a freely hanging cable under the influence of gravity, has the advantage that when used as a pressure line the lateral load is ideally only dissipated over normal forces, i.e. no bending moment occurs. However, forms that are simpler to produce than the catenoid may also counterbalance different load conditions. The reason for this is that it has been shown that it is expedient not to allow horizontal components to occur as a result of the normal force applied. In practice, this is approximately realized by using a section of an ellipse or a parabola. An advantage of this form is that the transferability of high lateral piston loads is realized with only a moderate increase in weight.

The axis of symmetry of the catenoid or the parabola or the main axis of the ellipse lies preferably along a straight line extending from the corresponding skirt wall, preferably the center thereof along the extent of the circumference. In other words, the vertex of the catenoid or the parabola or one of the main vertices of the ellipse lies at the respective corresponding skirt wall and preferably at the center thereof in the circumferential direction.

Moreover, it is preferred that the axis of symmetry or the main axis runs between the two box walls. The direction thereof is preferably substantially parallel to the box walls and/or perpendicular to a straight line through the central points of any piston bosses. In particular, in the case of the ellipse the secondary axis preferably extends between the box walls and in a region between a connecting line between the central points of the piston bosses and a skirt wall section. Accordingly, said ellipse can extend, for example, from the skirt wall section to the region between the piston bosses. Thus, the length of the secondary axis of the ellipse substantially corresponds to the distance between the box walls, and the main axis of the ellipse substantially corresponds to half of the piston diameter. The secondary axis of the ellipse preferably runs parallel to the pin axis, i.e. the connecting line between the central points of the piston bosses.

Here, and in the rest of the application, skirt walls are understood as being that part of the outer circumference of a piston which, during use, abuts against the cylinder walls of an internal combustion engine and is accordingly substantially cylindrical. The box walls are the parts of the outer circumference of the piston set back with respect to this.

Furthermore, it is preferred that the region extends in the direction perpendicular to the piston crown over a section that includes the edge of the piston skirt opposite the piston crown. This has the advantage that the edge of the piston, which is one of the parts subjected to the greatest loads, profits from the design according to the invention and therefore in particular cracks and weakening of the material are avoided here.

Moreover, it is preferred that the at least one region extends in the direction perpendicular to the piston crown over a section that is flush with the piston crown. In this way, intersections between recess sections having the form according to the invention and others which do not have this form are avoided, which avoids potential strain between these regions. This also has the advantage that the stability of the piston is further increased since a larger area of the piston is now reinforced.

It is furthermore preferred that the region of the recess that has the above-mentioned geometric form extends over at least the entire width of the skirt wall. This has the advantage that the rigidity of the skirt wall is further increased here as well. Moreover, intersections between recess wall sections with the geometric form and those without this form are also avoided here, which is why strain that could contribute to weakening the material is avoided here as well.

It is also preferred that the partial region of the recess having the above-mentioned geometric form extends over one or all of the box walls of the piston. Also here the advantage is that the rigidity and stability of the skirt wall is further increased than was the case with the previous preferred embodiments. Such regions can be, for example, at least 10%, 20%, 50% or 100% of the extent of the circumference of the respective box wall.

Moreover, this form allows the arrangement of the box walls radially "inward" at the pin bosses viewed from the center of the piston. While in other pistons the pin bosses largely lie inside the box walls, this is preferably different with the piston according to the invention. This has the advantage that the pressure line according to the invention is not interrupted. The piston is therefore characterized by a further increased stability. This also leads to a reinforcement of the block support.

A further preferred embodiment is that all pin bosses have a form as described above. This has the advantage that both sides of the piston now act symmetrically and therefore the load is carried by both sides to approximately the same extent, which results in reduced wear.

A further preferred embodiment is that the skirt wall on the pressure side of the straight line opposite the vertex line of the geometric figure of the recess closest to the outer wall has an increasing thickness in at least one circumferential direction. This has the advantage that the greater loads on the sides of the piston are carried by more material. Thus, the piston is more resilient.

A further preferred embodiment is that the skirt wall on the pressure side of the straight line opposite the vertex line of the geometric figure closest to the outer wall has an increasing thickness in both circumferential directions. This has the advantage that both sides of the skirt wall now behave in the same way and therefore strain and wear of the less strong side are avoided.

It is also preferred that the two last-mentioned design forms are also present on the counter pressure side. Even if this side is subjected to less pressure, it is nevertheless expedient to avoid wear and strain here as well, which is why these embodiments lead to reduced wear.

Moreover, it is preferred that in the piston the skirt walls at the intersection to the box walls are thicker than the box walls. This has the advantage that it is possible to work in a material-saving manner since the skirt walls are the parts of the piston that are subjected to high loads, while the box walls are subjected to comparably small loads.

Furthermore, a piston is preferred in which the thickness of one, preferably of all, of the box walls increases when one moves from the line which lies on the recess surface and which is closest to the central axis of the piston towards the skirt walls. This has the advantage that in this way the intersection to the skirt walls can be formed in a continuous manner since an intersection between walls with very different thicknesses can thereby be avoided.

BRIEF DESCRIPTION OF THE DRAWING

FIG. 1 is a bottom view of a piston according to the invention.

DETAILED DESCRIPTION OF A PREFERRED EMBODIMENT OF THE INVENTION

A preferred embodiment of the piston according to the invention will now be described with reference to FIG. 1.

The piston 10 shown in FIG. 1 comprises piston bosses 18 formed in a piston skirt 24 for receiving a piston pin (not shown). The piston skirt 24 comprises two skirt walls 12, 14 and two box walls 16 which surround a recess 20. In the installed state the piston pin (not shown) passes through the piston bosses 18, which are formed in the box walls 16, and the recess 20.

The skirt walls 12, 14 are designed differently, regardless of whether they are provided for use on the pressure side PS or on the counter pressure side CPS: The inner side 22 of the skirt wall 12 on the pressure side is formed as a parabola, with this parabola being formed in a continuous manner from the edge of the skirt wall to the piston crown, while the inner side of the skirt wall 14 on the counter pressure side is not formed in this way.

This parabola lies here such that the vertex thereof lies along the circumferential direction in the center of the corresponding skirt wall 14. Moreover, the axis of symmetry of the parabola extends perpendicular to the connecting line between the central points of the piston boss 18.

Furthermore, the box walls 16 are positioned "inwards" at the pin bosses 18, i.e. viewed from the central axis of the piston they extend outwardly beyond the outer surface of the corresponding box wall 16. Moreover, in the piston shown the skirt walls 12, 14 at the point of intersection between these and the box walls 16 are wider than said box walls, and the point of intersection is also characterized by an intersection between the box wall and the skirt wall at which the outer surface comprises an outward projection at the intersection. The projection results from the skirt wall substantially assuming the form of the piston while the box wall is at least at the points of intersection between the box wall and the skirt wall approximately perpendicular to this surface. Moreover, the skirt wall 12, 14 is thicker when one moves away from the straight line which, in the case of the pressure side, is away from the vertex of the geometric figure or, in the case of the counter pressure side, from the diametrically opposite line CPS.

The invention claimed is:

1. A piston for use in internal combustion engines; comprising:

a piston skirt encompassing skirt walls and box walls;

the skirt walls and box walls delimiting a recess;

at least one of the skirt walls is provided for use on the pressure side of the piston in the installed state; and, wherein in a region of the at least one skirt wall the recess is delimited in the form of a shape selected from a group consisting of: a parabola, a section of an ellipse or a catenoid lying in a plane which is substantially parallel to a crown of the piston, and wherein the delimited recess extends over the entire width of the skirt wall.

2. The piston according to claim 1, wherein the region of the at least one skirt wall extends in a direction perpendicular to the piston crown over a section which includes an edge of the piston skirt opposite the piston crown.

3. The piston according to claim 1, wherein the region of the at least one skirt wall extends in a direction perpendicular to the piston crown over a section which is flush with the piston crown.

4. The piston according to claim 1, wherein the recess extends over at least one region of one of the box walls.

5. The piston according to claim 4, wherein the recess extends over regions of all of the box walls of the piston.

6. The piston according to claim 1, including piston bosses for receiving pins at the box walls, wherein at least one of the piston bosses extends outwardly beyond an outer surface of the corresponding box wall, viewed from a central axis of the piston.

7. The piston according to claim 6, wherein all of the piston bosses that are formed in the box walls for receiving pins extend outwardly beyond the outer surface of the corresponding box wall, viewed from the central axis of the piston.

8. The piston according to claim 1, wherein the skirt wall on the pressure side of a straight line opposite a vertex line of the shape of the recess closest to an outer wall of the piston has an increasing thickness in at least one circumferential direction.

9. The piston according to claim 8, wherein the skirt wall on the pressure side of the straight line opposite the vertex line of the shape of the recess closest to the outer wall has an increasing thickness in both circumferential directions.

10. The piston according to claim 8, wherein the skirt wall on the counter pressure side of the straight line at the outer wall of the piston, which is diametrically opposite the vertex line of the shape of the recess with respect to a central axis of the piston, has an increasing thickness in at least one circumferential direction.

11. The piston according to claim 1, wherein at least one of the skirt walls at an intersection to the box walls are thicker than the box walls.

12. The piston according to claim 1, wherein a thickness of at least one of the box walls increases in a direction moving away from a line lying on a recess surface and closest to a central axis of the piston towards the skirt walls.

13. The piston according to claim 1, wherein the piston skirt includes piston bosses aligned with one another along a pin axis for receiving pins, and wherein an axis of symmetry of the parabola, ellipse, or catenoid is perpendicular to the pin axis.

* * * * *